US007314142B2

(12) United States Patent
Lyman, Jr.

(10) Patent No.: US 7,314,142 B2
(45) Date of Patent: Jan. 1, 2008

(54) PEN HOLDER WITH PEN CAP HOLDER

(76) Inventor: Hugh Marion Lyman, Jr., 27639 SE. 401st St., Enumclaw, WA (US) 98022

( * ) Notice: Subject to any disclaimer, the term of this patent is extended or adjusted under 35 U.S.C. 154(b) by 281 days.

(21) Appl. No.: 11/116,607

(22) Filed: Apr. 29, 2005

(65) Prior Publication Data

US 2006/0243622 A1 Nov. 2, 2006

(51) Int. Cl.
*A47F 7/00* (2006.01)
*A45C 11/34* (2006.01)

(52) U.S. Cl. ..... 211/69.5; 206/214; 211/60.1

(58) Field of Classification Search ..... 206/214, 206/224, 371; 211/69.1–69.5, 60.1; 401/131
See application file for complete search history.

(56) References Cited

U.S. PATENT DOCUMENTS

| | | | | |
|---|---|---|---|---|
| 1,620,529 | A | | 3/1927 | Ferris |
| 1,641,829 | A | | 9/1927 | Sheaffer |
| 1,641,846 | A | | 9/1927 | Fremon |
| 1,762,104 | A | | 6/1930 | Liddell |
| 1,789,439 | A | | 1/1931 | Horix |
| 1,804,120 | A | | 5/1931 | Sengbusch |
| 2,011,040 | A | | 8/1935 | Cuthbert |
| 2,082,831 | A | | 6/1937 | Hansen |
| 2,957,270 | A | | 10/1960 | Kennamer |
| 3,428,380 | A | | 2/1969 | Daniczek |
| 3,463,323 | A | | 8/1969 | Riepe |
| 3,476,257 | A | | 11/1969 | O'Connell |
| 3,866,992 | A | | 2/1975 | Katz |
| 4,253,830 | A | | 3/1981 | Kazen |
| 4,334,622 | A | * | 6/1982 | Mutschler ..... 211/69.5 |
| 4,355,726 | A | * | 10/1982 | Mutschler ..... 211/69.5 |
| 4,415,092 | A | | 11/1983 | Boyer |
| 4,493,575 | A | | 1/1985 | Mutschler |
| 4,573,818 | A | * | 3/1986 | Kodera ..... 401/131 |
| 4,826,338 | A | | 5/1989 | Kilpatrick |
| 4,850,484 | A | | 7/1989 | Denman |
| D305,777 | S | * | 1/1990 | Lee ..... D19/85 |
| 5,033,629 | A | | 7/1991 | Caine |
| 5,163,549 | A | | 11/1992 | Hayduchok |
| 5,188,242 | A | | 2/1993 | Smith |
| 5,232,103 | A | | 8/1993 | Koenig |
| 5,337,906 | A | | 8/1994 | Digiulio |
| 5,405,024 | A | | 4/1995 | Sahf |
| 5,447,243 | A | | 9/1995 | Graber |
| 5,544,764 | A | | 8/1996 | Cima |
| 5,628,400 | A | | 5/1997 | Feder |
| 5,823,363 | A | | 10/1998 | Cassel |
| 5,850,917 | A | | 12/1998 | Denton |
| 5,880,713 | A | | 3/1999 | Belardinelli |

(Continued)

*Primary Examiner*—Bryon P. Gehman

(57) ABSTRACT

The pen holder holds separately a pen and a mating pen cap. The pen cap is removed from the pen and is stored on a pen cap clip. The pen cap clip is attached to a pen well. The pen well has a pen cavity hole for holding the various sizes and styles of marker and/or highlighter pens. The writing tip of the pen is protected from circulating air in a smaller pen tip cavity at the bottom of the pen cavity hole. The pen is ready for use without having to remove the pen cap. The pen holder can be mounted to any vertical, horizontal or inclined surface or placed on a desk-top where convenient to the user.

4 Claims, 2 Drawing Sheets

U.S. PATENT DOCUMENTS 6,202,862 B1 3/2001 Acquaviva
6,257,539 B1 7/2001 Pelaez
6,871,767 B2 * 3/2005 Perlman et al. ..... 206/214
2004/0060952 A1 4/2004 Perlman

* cited by examiner

PEN HOLDER WITH PEN CAP HOLDER

FIELD OF INVENTION

The present invention relates to a pen holder and, more particularly, to a marker and highlighter pen holder that can mount in any plane from horizontal to vertical for convenient ergonomically access, accommodate a variety of pen styles and sizes, keeps the pen tips from drying out and holds the pen caps in relation to the position of the stored pens.

Further reference to a marker and highlighter pen holder will be referred to as a "pen holder".

BACKGROUND OF THE INVENTION

With the many different pens available in today's market there is a need to hold whichever type pen the consumer uses at a ergonomically convenient place for convenient access in the working environment, preferably off of the cluttered work surface. Pens with caps present a further problem, that of being misplaced, hidden under papers and other materials on the work surface. Highlighter and marker pens dry out when left with their caps off for extended periods of time. It is also important in storing pens with caps removed that they are not cross stored in different cavity wells where the colors of one pen can contaminate the color of another pen at its tip. Continually removing and resetting caps to keep the tips from drying out on some pens is annoying and sometimes difficult when one is marking multiple pages of documents and using different color pens.

There are numerous patents and prior art associated with pen holders where one-handed operation is desired. U.S. Pat. No. 1,620,529 to Ferris, U.S. Pat. No. 1,641,829 to Sheafer, U.S. Pat. No. 1,641,846 to Fremon, U.S. Pat. No. 1,762,104 to Liddel, U.S. Pat. No. 1,789,439 to Hoix, U.S. Pat. No. 1,804,120 to Sengbusch, U.S. Pat. No. 2,011,040 to Cuthbert, U.S. Pat. No. 2,082,831 to Hansen, U.S. Pat. No. 2,957,270 to Kennamer, U.S. Pat. No. 3,428,380 to Danjczek, U.S. Pat. No. 3,463,323to Riepe, U.S. Pat. No. 3,476,257 to O'Connell, U.S. Pat. No. 3,866,992 to Katz, U.S. Pat. No. 4,415,092 to Boyer, U.S. Pat. No. 4,493,575 to Mutschler, U.S. Pat. No. 4,826,338 to Kilpatrick, U.S. Pat. No. 4,850,484 to Denman, U.S. Pat. No. 5,033,629 to Caine, U.S. Pat. No. 5,163,549 to Hayduchok, U.S. Pat. No. 5,337,906 to Digiulio, U.S. Pat. No. 5,405,024 to Sahf, U.S. Pat. No. 5,447,243 to Graber, U.S. Pat. No. 5,544,764 to Cima, U.S. Pat. No. 5,628,400 to Feder, U.S. Pat. No. 6,257,539 B1 to Pelaez and US 2004/0060952 to Perlman are examples of such pen holders. Some of the preceding discloses methods of keeping the pen tips from drying out. Most of these examples are limited to one pen size and style. It is apparent that most of these inventions are complex and would be relatively expensive to produce. Further, none of them address any means for storing the pen caps. US 2004/0060952 application to Perlman and U.S. Pat. No. 5,163,549 to Hayduchok discloses a complex means for holding a pen cap so that the pen is always inserted into the cap. This device requires awkward manipulations for installing and as pens snap into the cap this art requires exerted force to remove the pen. U.S. Pat. No. 6,202,862 B1 to Acquaviva also requires the device being held by a wall bracket or a second hand, further it is also relatively expensive to produce requiring foam type material inlayed in the cavity wells. U.S. Pat. No. 3,463,323 to Riepe discloses a complicated device for India ink pens with pen cap receptacles for holding the pens caps, however, this is limited to one type of pen and its specific cap. U.S. Pat. No. 6,257,539 B1 to Pelaez is a simple pen holder limited to one size and style pen and is designed for setting on a horizontal surface only. U.S. Pat. No. 5,880,713 to Belardinelli presents an ingenious device for storing pens and other desktop articles but does not address storing pen caps or any method to keep marker and highlighter pens from drying out.

Heretofore, no device has been created to fulfill the need for a pen holder that accommodates different size pens, different styles of pens, be placed or mounted on any plane surface from horizontal to vertical at any angle and reduces evaporation of liquid inks. Moreover, no current approach addresses the problem for storing a variety of different style pen caps, is simple and inexpensive to produce, and further does not require exerted force to remove the pen from the pen holder.

It is therefore an object of the invention to have a pen holder that mounts to any surface from horizontal to vertical.

It is another object of the invention to have a pen holder that accepts different size pens.

It is another object of the invention to have a pen holder that accepts different styles and configurations of pens.

It is another object of the invention to have a pen holder that accepts the attachment of pen caps.

It is another object of the invention to have a pen holder that minimizes the evaporation of the pen's ink.

It is another object of the invention to have a pen holder that is simple and inexpensive to fabricate.

SUMMARY OF THE INVENTION

In accordance with the present invention, there is provided a pen holder that conveniently stores different sizes and styles of pens and provides a means for holding the pen caps. The invention can be adjustably placed on any surface from horizontal to vertical at any angle such as a work surface, tilting printer lid, side of a computer, on a monitor, a pencil sharpener and any other convenient surface by means of a mounting pad or other attaching means The invention can be fabricated from any suitable material such as wood, plastic, and metal. The pen holder has multiple pen cavity wells. The cylindrical pen cavity well has a pen cavity hole to hold the body of the pen. At the bottom of the pen cavity hole is a lower cylindrical hole of a smaller diameter and depth that will accept a variety of pen neck configurations so that some portion of the pen's neck that holds the pen tip will engage at the top edge of the lower cylindrical cavity so as to form a seal at the neck of the pen to minimize the circulation of air at the tip, thus preventing the tip from drying out. Each pen cavity well has its dedicated pen cap holder for attaching an associated pen cap to the pen holder separately from the pen. As pen caps are identified with the color of the pen's ink, having that pen cap attached to a pen cap holder of a particular pen cavity well insures that the user always replaces the pen in that cavity well thus eliminating contamination of ink colors from other cavities. The pen cap holder further eliminates the potential for misplacing the pen cap.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 5:
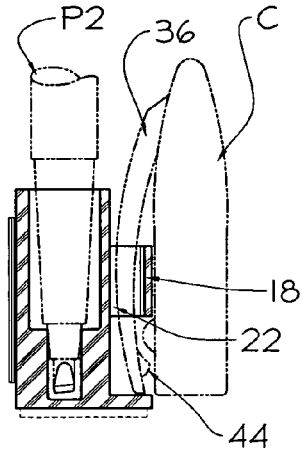
FIG. 5 is a cross sectional view of a pen holder of this invention through plane B-B showing pen stored in cavity well and associated pen cap stored in pen cap clip.

Generally speaking, the invention comprises a pen storage unit for holding different types and styles of marker and highlighter pens. The invention comprises a plurality of adjacent cylindrical pen cavity wells. Each pen cavity well is the same size and shape and of a size to accept receiving different sizes and styles of pens. Each cavity well has an associated pen cap holder rigidly attached for storing the pen cap of each pen separately from the pen as shown in FIG. 5.

Figure 1:
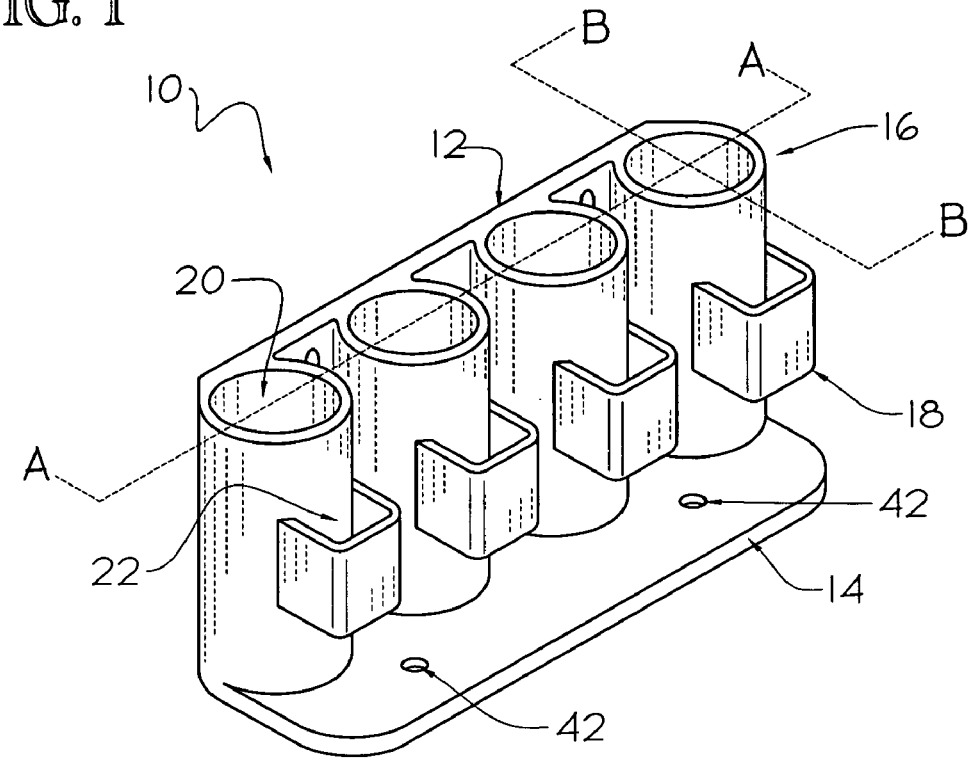
FIG. 1 is an isometric front view of a pen holder of this invention.

Now referring to FIG. 1, an isometric front view of a pen holder 10 illustrating the vertical base plate 12, horizontal base plate 14, cylindrical pen cavity wells 16 with pen cavity holes 20. Each of the pen cavity wells 16 are spaced ergonomically apart to facilitate ease of withdrawing a pen without disturbing adjacent pens. Each pen cavity well 16 has an associated pen cap holder 18 for receiving a pen cap C. The pen holder 10 illustrated has four pen cavities wells 16, but it is evident that a single or any multiple arrangement of pen cavities wells 16 may be provided in different configurations. Further, provided are holes 42 in the vertical base plate 12 and the horizontal base plate 14 for mounting the pen holder 10 to a surface with fasteners.

Figure 2:
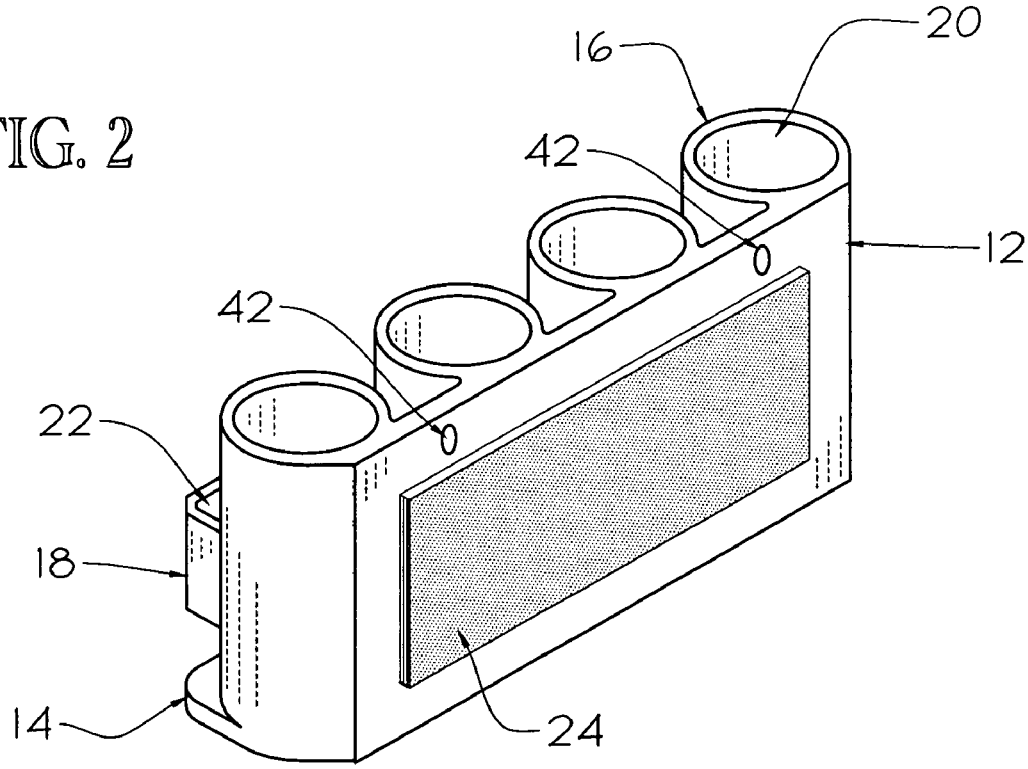
FIG. 2 is an isometric back view of a pen holder of this invention with mounting pad positioned for angled and vertical mounting.

Referring to FIG. 2, an isometric back view of a pen holder 10 illustrating an adhesive backed mounting pad 24 connected to the vertical base plate 12. The mounting pad 24 can be placed on either the vertical base plate 12 or the horizontal base plate 14 so as to mount the pen holder 10 at the user's most convenient location.

Figure 3:
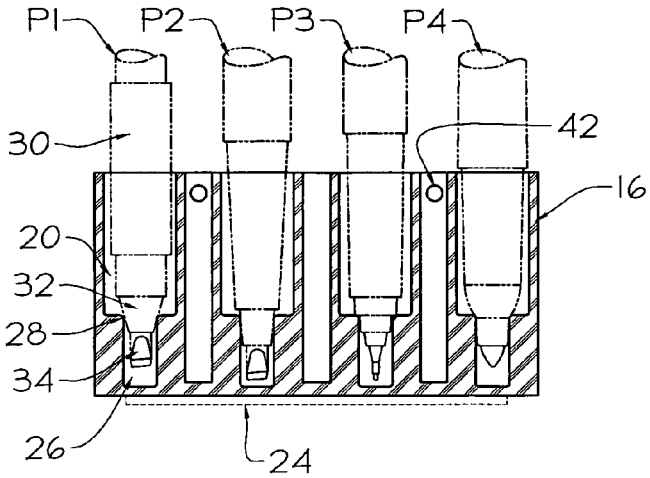
FIG. 3 is a cross section view of a pen holder of this invention front view plane A-A in FIG. 1. illustrating different pen styles in the pen holder.

Referring to FIG. 3, which is a cross sectional view of a pen holder 10 through the dashed line plane A-A shown in FIG. 1, illustrating four different current style pens P1, P2, P3 and P4 held in the pen cavity holes 20. it would be apparent to anyone skilled in the art to see that other instruments can also be held, such as ball point pens, pencils and other elongate instruments. When placing pens in the pen cavity holes 20, the pen necks 32 fit into the pen tip cavity 26, resting on the pen tip cavity edge 28 at the top of the pen tip cavity 26, thereby making a seal for restricting circulating air from drying out the pen tip 34. The pen body 30 easily fits into the pen cavity hole 20 for effortless withdrawal. When the pen holder 10 is mounted at an angle less than vertical the pen body 30 will lean to the downside edge of the pen cavity hole 20 a distance relative to the diameter of the pen body 30 and the pen cavity hole 20. This does not affect the effectiveness of the pen tip cavity edge 28 from restricting circulating air in the pen tip cavity 26.

Figure 4:
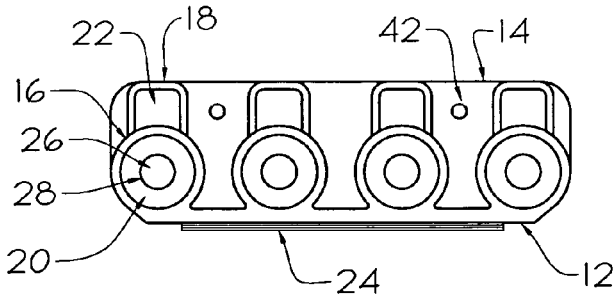
FIG. 4 is a top plan view of a pen holder of this invention.

Referring to FIG. 4, which is a top plan view of the pen holder 10 further illustrating the position of the pen tip cavity 26 in relation with the pen cavity hole 20 and the pen cap holder cavity 22 in relation with the pen cap holder 18.

Referring to FIG. 5, which is a cross sectional view of a pen holder 10 through the dashed line plane B-B illustrating how the pen cap pocket clip 36 of pen cap C is positioned when attached on the pen cap holder 18. The dimensions and the position of the pen cap holder 18 are designed to accommodate a variety of various sizes and styles of pen caps C. The pen cap C is placed on the pen cap holder 18 by snapping the pen cap pocket clip 36 over the pen cap holder 18 into the pen cap holder cavity 22 in the position as shown.

Figure 6:
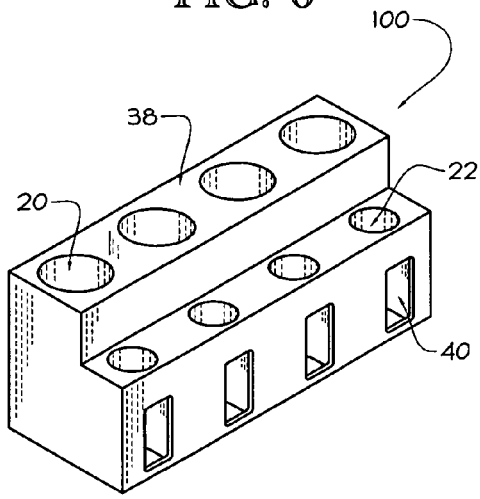
FIG. 6 is an isometric view of an alternate design pen holder fabricated from a solid block of material.

Referring to FIG. 6, there is shown an alternate embodiment of the pen holder 10 shown in FIG. 1. The alternate pen holder 100 is fabricated from a solid block of material 38 such as an exotic wood, for designer conscious users. The opening 40 provided accommodates the small tab 44 on the end of the pen cap pocket clip 36.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A pen holder for holding a pen and its associated pen cap, the pen cap including a pocket clip, the pen holder comprising:

a) at least one pen cavity well each including a pen cavity hole for holding a respective pen, wherein each pen cavity hole can hold various sizes and styles of pen; and b) at least one pen cap holder each for separately holding an associated pen cap, each respective pen cap holder being rigidly attached to one said pen cavity well, whereby each associated pen cap may be held separately from its respective pen on said pen holder by snapping its pocket clip over its corresponding pen cap holder.

2. A pen holder as recited in claim 1, wherein provided at the bottom of each said pen cavity well is a pen tip cavity, smaller in diameter than its corresponding pen cavity hole for accepting a pen neck of a pen, and further providing a pen tip cavity edge at the top of each said pen tip cavity, wherein when a pen is held in one said pen cavity hole, its pen neck sealingly engages the corresponding pen tip cavity edge, thereby sealing the pen tip of the pen from circulating air.

3. A pen holder as recited in claim 1, wherein said pen holder is provided with an adhesive mounting pad attached to a base plate of said pen holder, whereby said pen holder can be mounted by the base plate to a surface.

4. A pen holder as recited in claim 1, wherein said pen holder is made from one of plastic, wood and metal.

* * * * *